United States Patent [19]

Schwartz et al.

[11] 4,214,348

[45] Jul. 29, 1980

[54] TRASH BY-PASS FOR BURR AND STICK MACHINE

[75] Inventors: Robert C. Schwartz; John E. Sparks, both of Lubbock, Tex.

[73] Assignee: Horn and Gladden Lint Cleaner Co., Inc., Lubbock, Tex.

[21] Appl. No.: 2,587

[22] Filed: Jan. 11, 1979

[51] Int. Cl.[2] ..... D01B 1/00

[52] U.S. Cl. ..... 19/203; 19/58

[58] Field of Search ..... 19/58, 106 R, 203, 262

[56] References Cited

U.S. PATENT DOCUMENTS

| | | | |
|---|---|---|---|
| 3,086,254 | 4/1963 | Mitchell et al. | 19/203 |
| 3,179,982 | 4/1965 | Mitchell | 19/203 |
| 3,186,036 | 6/1965 | Word | 19/203 |
| 3,528,138 | 9/1970 | Elder | 19/203 |
| 4,102,017 | 7/1978 | Foerster | 19/203 |

*Primary Examiner*—Louis Rimrodt

*Attorney, Agent, or Firm*—Wendell Coffee

[57] ABSTRACT

A trash by-pass panel is pivoted to the reclamation chute wall in a cotton gin burr and stick machine such that it may be opened to allow heavier trash to be excluded from further processing, thereby increasing the efficiency of the cotton cleaning.

4 Claims, 1 Drawing Figure

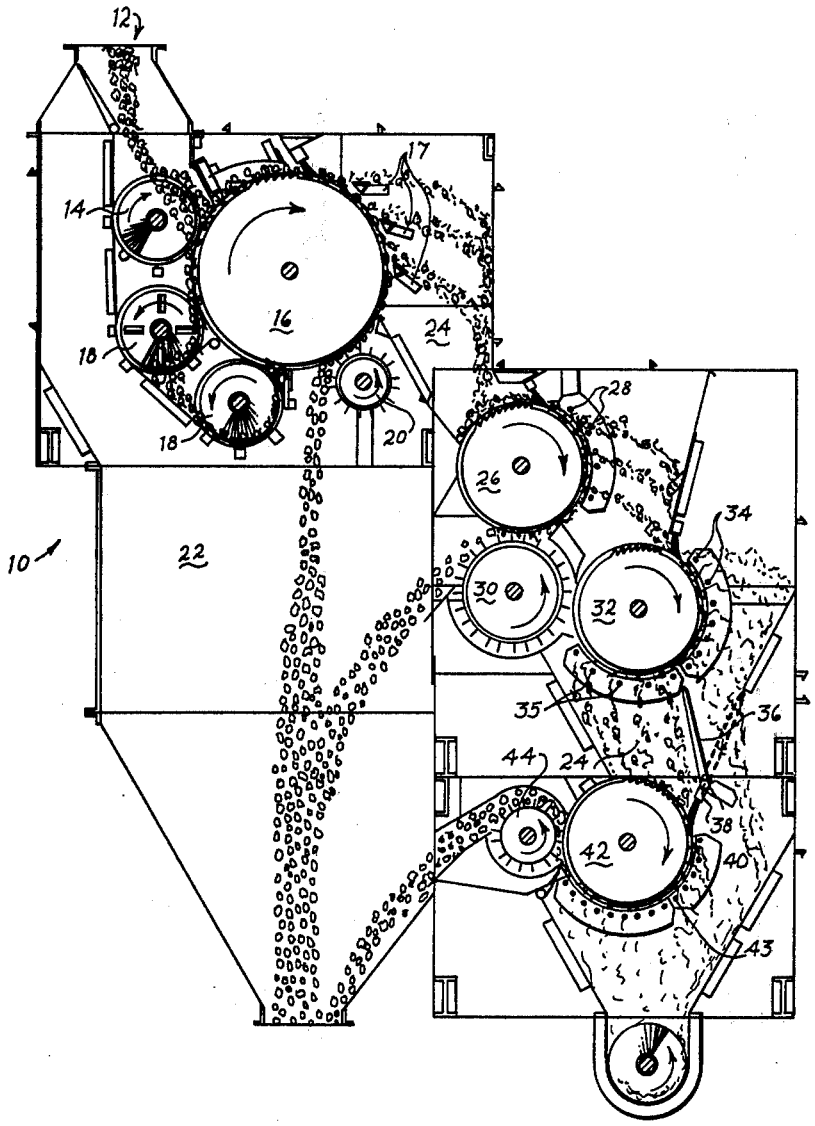
12
17
14
16
24
18
18
20
28
26
34
10
22
30
32
35
36
44
24
38
42
40
43

TRASH BY-PASS FOR BURR AND STICK MACHINE

BACKGROUND OF THE INVENTION:

(1) Field of the Invention

This invention relates to cotton processing and more specifically to the separation of trash from cotton prior to ginning.

(2) Description of the Prior Art

The grade that a sample of cotton is assigned is very important in determining the value of the cotton. An important consideration in the grading of cotton is its cleanliness. Through the years, many methods of cleaning cotton have been tried, including methods which attempt to remove trash, including burrs, sticks, etc. from the seed cotton. It is desirable to reclaim cotton which might be removed with the trash. The most effective manner of cleaning cotton has been a three or four step process in which the same procedure is repeated until the trash which is excluded has little reclaimable cotton associated with it.

In the step which is repeated the cotton is engaged or snagged by the teeth of rotating saws and beat against bars. This beating frees the cotton from trash. The saws on which the cotton is engaged are rotating so the trash is thrown outward by centrifugal force. The heavier trash is thrown farther away from the saw cylinders.

The cleaned cotton which remains snagged by the saws is removed from the saws by means of doffing brushes. The doffing brushes rotate in the opposite direction of the saws. Once the clean cotton is removed from the saws, it is forwarded through a chute for further processing.

The trash which is expelled at the first level still has reclaimable cotton mixed with it. This trash is forwarded toward reclamation saws and associated beater bars. Once again the cotton is snagged by saws on one of the rotating saw cylinders and is beat against the bars. In this manner, the cotton is separated from the trash which is once again expelled. This process is most often repeated twice more, i.e., the trash is exposed to saw cylinders so that cotton may be engaged by rotating saw cylinders four times and beat against bars four times. After each cleaning step, the cotton is removed to a clean cotton chute and the refuse is further processed except for the final step. In effect, cotton is pulled or separated from the same trash four times. The total efficiency of the cleaning process is clearly limited by having to separate cotton from the same trash time after time.

An average bale of seed cotton which is brought to a gin weighs about 1,900 pounds. Of this 1,900 pounds, only 500 pounds (about 25% weight) is cotton lint. About 800 pounds (40%) is seed and the remaining 600 pounds (35%) is trash. It is estimated that stick and burr machines, before our invention, removed about 250 pounds of the trash with a loss of under 1 pound of good cotton. The effort to prevent loss of cotton has resulted in incomplete cleaning. Each improvement in the cleaning process improves the grade of the ginned cotton and so ginners and manufacturers have tried for years to improve this cleaning process.

SUMMARY OF THE INVENTION:

(1) New and Different Function

We have invented a trash by-pass which improves the efficiency of burr and stick machines in cotton gins. We have found that by using our trash by-pass, we are able to extract about 320 pounds of trash in the stick and burr machine from a standard 1,900 pound bale of cotton from the field. This superior cleaning performance (compared to 250 pounds of trash extracted by prior practice) leads to better grades for cotton and greater profits without the loss of appreciable cotton.

We accomplish the improved cleaning by placing a pivoting panel in a position which allows some trash to be expelled from the cleaning process after preliminary cleaning. By moving the by-pass panel into the full by-pass position, we exclude certain of the trash from further reclamation steps and, thereby, increase the efficiency of the subsequent steps.

Trash is separated from the cotton by a combination of beating and centrifugal force so that heavier material is thrown further from the rotating saw cylinders and beater bars. The trash by-pass panel may be adjusted such that only the heaviest of the trash is excluded from further processing. The heavier trash is less likely to contain reclaimable cotton. Alternatively, the by-pass may be closed into the clean position to maximize the reclamation of any cotton which is still mixed with trash.

When the by-pass panel is at least partially open, some trash is expelled and each succeeding step may be more selective, and thus, more efficient.

Though some cotton is lost where the trash is by-passed, the amount of reclaimable cotton which is actually lost is negigible (less than 2 pounds of a 1,900 pound sample). The improved grade of the cotton more than compensates for the incidental loss in cotton.

(2) Objects of this Invention

An object of this invention is to improve the efficiency of cotton gin burr and stick machines.

A further object is to improve the grade of cotton which is ginned.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require skilled people to install, adjust, operate, and maintain.

The specific nature of the invention, as well as other objects, uses, and advantages thereof, will clearly appear from the following description and from the accompanying drawing, which is not scale drawing.

BRIEF DESCRIPTION OF THE DRAWING:

The FIGURE is a schematic cross sectional representation of an embodiment of our invention.

DESCRIPTION OF THE PREFERRED EMBODIMENT:

Referring to the drawing, there may be seen a typical cotton gin burr and stick machine 10. The machine has cotton inlet 12 through which the cotton passes to a first set of rotating saws 16. The rotating saws are oriented around a main saw cylinder. The cotton is introduced to the saws 16 by directing conveyor 14. Not all of the cotton introduced through the inlet 12 is snagged by the saws. The cotton not engaged is returned to the saw cylinder by means of one of a plurality of return conveyors 18. The return conveyors rotate opposite the first set of saws. After being snagged by saws 16, the cotton is beat against beater arms 17. This beating separates the cotton from trash such as sticks and burrs. The trash along with the cotton which is beat from the first saw cylinder 16, is thrown outward by centrifugal force, then funnelled or forwarded on to first reclamation saw cylinder 26 through reclamation chute 24. The clean cotton which remained snagged by saws 16 after the beating is removed from the saws by means of doffing brushes 20. The doffing brushes 20 rotate in concert with the first saw cylinder 16 and remove cotton from the saws, sending or forwarding it through clean cotton chute 22 for further processing.

Beater bars 28 are proximate to the first set of reclamation saws 26. The reclamation saws are oriented around a rotating cylinder. The cotton mixed with the trash from the main cylinder 16 is snagged by the reclamation saws 26 and beat on beater bars 28. The beater bars 28 are arranged in a quarter-circle around the first reclamation saw cylinder 26. The trash and cotton separated from the first reclamation saws 26 becomes engaged or snagged on a second set of reclamation saws 32 and the beating process occurs again. Beater bars 34 and 35 are arranged in a semi-circle around the saws. Doffing brushes 30 are situated such that they remove cotton from both the first and second reclamation saw cylinders. Once the cotton is removed from these reclamation saws, it is sent through the clean cotton chute 22 for further processing.

Trash by-pass panel 36 is pivoted to reclamation chute wall 40 at pivot 38. The position of the by-pass panel is adjustable by means of screws which extend to the panel from the exterior of the machine (not shown for clarity). The by-pass panel may be in the by-pass or open position, extending to an intermediate point of the beater bars of the second (next to final) reclamation saw. The panel may be in a clean or closed position (shown in broken line), or any of a number of intermediate positions.

When the trash by-pass panel 36 is in the open position, trash which is separated from the cotton by the first quarter bars 34 of saws 32 is expelled from further processing. Trash which is beat off the saws in the second quarter bars 35 is more likely to have reclaimable cotton with it and so it is always forwarded to a final reclamation saw cylinder 42. Beater bars 43 are in close proximity to the saws of cylinder 42 and after the cotton is snagged by the saws, it is beat one final time. The trash which is separated from the cotton on this beating is expelled from further processing. Cotton which has remained snagged by the saws is removed therefrom by doffing brushes 44. The clean cotton is forwarded into clean cotton chute 22 and thence for further processing.

The reclamation before the trash by-pass is called the first stage and the reclamation after the by-pass panel is called the final stage.

If inspection reveals that trash separated from the first quarter bars 34 of the second reclamation saw cylinder has excessive cotton associated with it, the trash by-pass panel 36 may be closed into the clean or chute position to facilitate the reclamation of the maximum amount of cotton.

It may be seen that flexibility in the arrangement of beater bars around saw cylinders as well as the adjustment which may be made in the by-pass panel facilitate a more efficient separation of cotton from trash than burr and stick machines currently in use.

Although the term "doffing brush" has been used, it will be understood by those skilled in the art that the doffing process could be achieved by doffing cylinders which might not have brushes in the traditional sense.

As an aid to correlating the terms of the claims to the exemplary drawing, the following catalog of elements is provided:

10 burr & stick machine
12 cotton inlet
14 directing conveyor
16 1st saws
17 beater arms
18 return conveyors
20 doffing brushes
22 clean cotton chute
24 reclamation chute
26 1st reclaim saws
28 beater bars
30 doffing brushes
32 2nd reclaim saws
34 1st beater bars
35 2nd beater bars
36 by-pass panel
38 pivot
40 reclamation chute wall
42 final reclaim saws
44 doffing brushes The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a cotton gin burr and stick machine having:

a. a cotton inlet,
b. a directing conveyor,
c. a first set of rotating saws,
d. a plurality of beater arms in proximity to said first set of rotating saws,
e. doffing brushes adjacent to the first set of rotating saws,
f. a clean cotton chute,
g. a reclamation chute,
h. a first set of reclamation saws in the reclamation chute,
j. a second set of reclamation saws in the reclamation chute,
k. doffing brushes adjacent to both the first and second set of reclamation saws,
m. beater bars in proximity to the first set of reclamation saws,
n. beater bars in proximity to the second set of reclamation saws,
o. a final set of reclamation saws,
p. beater bars in proximity to said final set of reclamation saws,
q. a set of doffing brushes adjacent to the final set of reclamation saws; the improved structure for the machine comprising:

r. a trash by-pass panel between the second and final set of reclamation saws,
s. said panel pivoted to said reclamation chute wall,
t. adjusting means attached to the panel for pivoting said panel, so that said panel either
(i) excludes the trash from or
(ii) directs the trash to the final set of reclamation saws according to its position.

2. In a stick and burr removing process including:
a. introducing seed cotton into a stick and burr machine,
b. engaging said cotton onto a first set of rotating saws,
c. beating said cotton against a plurality of beater arms adjacent to the first set of rotating saws, thereby
d. separating trash and reclaimable cotton from that cotton engaged on the first set of rotating saws,
e. doffing the cotton which remains on said first set of rotating saws from said saws by doffing brushes, and
f. forwarding the doffed cotton through a clean cotton chute,
g. forwarding said trash and reclaimable cotton to a first stage of reclamation saws through a reclamation chute,
h. engaging said reclaimable cotton on the first stage of reclamation saws,
j. separating clean cotton from trash and other reclaimable cotton by beating on a set of beater bars,
k. engaging said other reclaimable cotton by a final stage of reclamation saws,
m. beating trash from the final stage of reclamation saws,
n. doffing the clean cotton on both stages of reclamation saws by doffing brushes, the improved method of selectively cleaning cotton comprising the steps of either:
o. excluding a portion of trash and reclaimable cotton separated at the first stage reclamation saw from the final stage through a trash by-pass,
p. forming said by-pass by
q. moving a by-pass panel, or
r. opening said by-pass panel only partially, thus
s. excluding only the heaviest trash from further cleaning, or
t. closing said by-pass panel, thus
u. reclaiming the maximum amount of cotton from the trash.

3. In a cotton gin burr and stick machine having
a. a main saw cylinder,
b. means for directing raw seed cotton to said main saw cylinder,
c. brushes for doffing cotton from said main saw cylinder into clean cotton chute,
d. plurality of beater arms proximate said main saw cylinder for separating trash and burrs into a reclamation chute,
e. at least two reclamation saw cylinders one of which is the final saw cylinder,
f. doff means for doffing cotton from each of the reclamation saw cylinders, and
g. beater bars proximate said reclamation saw cylinders each set of bars having first bars and last bars, the improved structure for the machine comprising:
h. a trash by-pass panel,
j. said trash by-pass panel being pivoted above and adjacent to said final reclamation saw cylinder,
k. said panel extending to either
(i) a clean position so that all of the trash removed from the next to final reclamation saw cylinder is directed to the final reclamation saw cylinder, or
(ii) a by-pass position adjacent to an intermediate point of the beater bars of the next to final reclamation saw cylinder so that the trash removed by the first bars of that reclamation saw cylinder is diverted directly to disposal and the trash removed by the last beater bars is directed to said final reclamation saw, or
(iii) any position intermediate the clean and by-pass positions.

4. The invention as defined in claim 3 further comprising:
m. at least two reclamation saw cylinders located before said last reclamation saw cylinder.

* * * * *